US006805944B2

(12) United States Patent
Oshika et al.

(10) Patent No.: US 6,805,944 B2
(45) Date of Patent: Oct. 19, 2004

(54) COATED CEMENTED CARBIDE CUTTING TOOL

(75) Inventors: Takatoshi Oshika, Naka-gun (JP); Toshiaki Ueda, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 127 days.

(21) Appl. No.: 10/101,972

(22) Filed: Mar. 21, 2002

(65) Prior Publication Data

US 2003/0070305 A1 Apr. 17, 2003

(30) Foreign Application Priority Data

| | | |
|---|---|---|
| Mar. 26, 2001 | (JP) | P2001-086666 |
| Mar. 26, 2001 | (JP) | P2001-086667 |
| Mar. 27, 2001 | (JP) | P2001-089144 |
| Oct. 31, 2001 | (JP) | P2001-333731 |
| Nov. 7, 2001 | (JP) | P2001-341523 |
| Nov. 12, 2001 | (JP) | P2001-345465 |
| Nov. 12, 2001 | (JP) | P2001-345742 |

(51) Int. Cl.[7] ..... C28C 16/30; B28P 15/28

(52) U.S. Cl. ..... 428/216; 51/307; 51/309; 427/419.2; 427/419.7; 128/336; 128/698; 128/701; 128/702

(58) Field of Search ..... 428/472, 469, 428/216, 336, 701, 698, 702; 51/307, 309; 427/419.2, 419.7

(56) References Cited

U.S. PATENT DOCUMENTS

| | | | | |
|---|---|---|---|---|
| 4,749,629 | A | * | 6/1988 | Sarin et al. |
| 4,984,940 | A | | 1/1991 | Bryant et al. |
| 5,137,774 | A | * | 8/1992 | Ruppi |
| 6,077,596 | A | * | 6/2000 | Hashimoto et al. |
| 6,309,738 | B1 | | 10/2001 | Sakurai |
| 6,333,099 | B1 | | 12/2001 | Strondl et al. |
| 6,426,137 | B1 | | 7/2002 | Oshika et al. |
| 2001/0016273 | A1 | | 8/2001 | Narasimhan et al. |

FOREIGN PATENT DOCUMENTS

| | | |
|---|---|---|
| CH | 609 380 | 2/1979 |
| EP | 0 727 509 | 8/1996 |
| EP | 1 103 635 | 5/2001 |
| JP | 6-8010 | 1/1994 |
| JP | 7-328808 | 12/1995 |
| WO | WO 99/29920 | 6/1999 |

* cited by examiner

*Primary Examiner*—Archene Turner
(74) *Attorney, Agent, or Firm*—Oblon, Spivak, McClelland, Maier & Neustadt, P.C.

(57) ABSTRACT

A coated cemented carbide cutting tool member having excellent ability to prevent breakage and chipping around its cutting edge, exhibits high wear resistance in severe cutting operations comprises a hard sintered substrate and a hard coating layer deposited on the surface of said substrate, the hard coating layer comprises an alternated multi-layer structure having a total thickness of between 0.5 to 20 $\mu$m and comprising the first thin layer of titanium compounds and the second thin layer of hard oxide materials whose individual thickness is between 0.01 to 0.3 $\mu$m.

8 Claims, No Drawings

COATED CEMENTED CARBIDE CUTTING TOOL

BACKGROUND OF THE INVENTION

1. Field of the Invention

The present invention relates to a coated cemented carbide cutting tool member (hereinafter referred to as a "coated carbide member") that has superior ability to avoid breakage and chipping around its cutting edge even when it is applied to extremely tough cutting operations for metal workpieces like those of steel and cast iron, such as high-speed cutting operations with thick depth-of-cut, high-speed cutting operations with high feed rate, interrupted cutting operations at high-speed and so on, all of the operations producing severe mechanical and thermal impacts at the cutting edge.

2. Description of the Related Art

It is well known that coated carbide members are preferably composed of a tungsten carbide-based cemented carbide substrate and a hard coating layer which comprises an inner layer having an average thickness of 0.5 to 20 $\mu$m and preferably composed of a titanium compound layer including at least one layer of titanium carbide (hereinafter referred to as "TiC"), titanium nitride (TiN), titanium carbonitride (TiCN), titanium carboxide (TiCO) and titanium carbonitroxide (TiCNO), and an outer layer having an average thickness of 0.3 to 15 $\mu$m and composed of aluminum oxide ($Al_2O_3$) layer which has several crystal polymorphs such as $\alpha$, $\kappa$, and $\gamma$. The hard coating layer could be formed preferably by means of chemical vapor deposition and/or physical vapor deposition. The coated carbide member is widely used in various fields of cutting operations, for example, continuous and interrupted cutting operations on metal workpieces such as those of steel and cast iron.

It is also well known that titanium compound layer has a granular crystal morphology and is used for many applications. Among them, TiC, TiCN and TiN layers have been widely used as highly abrasion resistant materials in many applications, especially in wear resistant layers of cutting tools. Furthermore, TiN layers have been widely used as surface decorative coatings because it has a beautiful external appearance similar to that of gold. For many coated carbide members, the outermost layers are made of TiN, and this facilitates distinguishing by machining operators of new cutting edges from the cutting edges which are already worn, even in dim environments.

A TiCN layer that has a longitudinal crystal morphology, produced by chemical vapor deposition in a moderate temperature range such as 700 to 950° C. using a reaction gas mixture which includes organic cyanide compounds such as acetonitrile ($CH_3CN$), has been well known as a highly tough and wear resistant coating layer, which was disclosed in Japanese Unexamined Patent Publications No. 6-8010 and No. 7-328808.

It is well known that a typical method for covering the substrate's surface with $Al_2O_3$ layer is a chemical vapor deposition (CVD) process using a gas mixture of $AlCl_3$, $CO_2$ and $H_2$ at around 1000° C., and that the typical conditions utilized in CVD-$Al_2O_3$ processes could mainly produce three different $Al_2O_3$ polymorphs, namely, the most thermodynamically stable $\alpha$-$Al_2O_3$, meta-stable $\kappa$-$Al_2O_3$ and $\gamma$-$Al_2O_3$. It is also well known that the specific polymorph of produced the $Al_2O_3$ layer is controlled by several operative factors, such as the surface composition of the underlying layer, the deposition condition of $Al_2O_3$ nucleation status and the temperature of the $Al_2O_3$ growth status.

In recent years, there has been an increasing demand for laborsaving, less time consuming, cutting operations. Accordingly, the conditions of these cutting operations have entered difficult ranges, such as high-speed cutting operations with thick depth-of-cut, high-speed cutting operations with high feed rate, and interrupted cutting operations at high-speed. For coated carbide members, there are few problems when they are applied to continuous or interrupted cutting operations on steel or cast iron under common cutting conditions.

If a conventional coated cemented carbide cutting tool is used under high speed cutting conditions, thermal plasticity tends to occur easily at the cutting edge due to lack of heat resistance of the outer layer composing the hard coating layer because of the heat generated during the cutting. In particular, the outer layer comprising the hard coating layer and the inner, layer both of which have relatively good thermal conductivity, and in addition, the thermal conductivity of $Al_2O_3$ forming the outer layer is 6 W/mK, and the thermal conductivity of TiN is 14 W/mK; thus, the high heat generated between the workpiece and the hard coating layer influences the carbide base, and the thermal plasticity transformation inevitably occurs on the cutting edge. Therefore, abrasion becomes partial due to the thermal plasticity; thus, the abrasion of the cutting edge advances noticeably, and the tool life of such cutting tool is relatively short.

Also, even though the $Al_2O_3$ layer as the outer layer composing the hard coating layer has superior hear resistance, if a conventional coated cemented carbide cutting tool is used under high speed intermittent cutting conditions with large mechanical and thermal impacts, because the $AL_2O_3$ as the outer layer composing the hard coating layer has more contact with the workpiece than the Ti chemical compounds as an inner layer during the cutting operation, the $AL_2O_3$ layer directly receives large mechanical and thermal impacts; thus, the tool life of such a cutting tool is short and chipping occurs easily on the cutting edge because of inferior toughness of the conventional coated cemented carbide cutting tool; thus, the tool life of such a cutting tool is short.

Therefore, there are severe problems of failure in relatively short times when they are used in tough cutting operations of these materials, and these are accompanied by severe thermal and mechanical impacts, because the $Al_2O_3$ layer, whose mechanical toughness is not sufficient in spite of its superior properties for thermal stability and thermal barrier effects, suffers detrimental thermal and mechanical impacts owing to its preferential contact as an outer layer with work materials, and this phenomenon induces the breakage or chipping around the cutting edge.

SUMMARY OF THE INVENTION

Accordingly, an object of this invention is to provide a coated carbide member that does not breake or chip around its cutting edge for a long period of time even when it is used in extremely tough cutting operations for metal workpieces such as those of steel and cast iron.

The object of the present invention has been achieved by the discovery of a coated carbide member whose cemented carbide substrate is coated with a hard coating layer having a total thickness of between 0.5 to 20 $\mu$m and preferably comprising an alternated multilayer structure of the first thin layer and the second thin layer whose individual thickness is between 0.01 to 0.3 $\mu$m, and the first thin layer is made of titanium compounds such as TiC, TiCN, and TiN, and the second thin layer is made of hard oxide materials such as $Al_2O_3$ and hafnium oxide ($HfO_2$).

This coated carbide member gives good wear resistance and long tool lifetime even when it is used in extremely tough cutting operations for metal workpieces like those of steel and cast iron.

DETAILED DESCRIPTION OF THE INVENTION

The present invention provides for a coated carbide member that is coated with a hard coating layer. A "coated carbide member" refers to the part of the cutting tool that actually cuts workpiece materials. The coated carbide member includes exchangeable cutting inserts to be mounted on bit holders of turning bites, face milling cutters, and end-milling cutters. It also includes cutting blades of drills and end-mills. The coated carbide member is preferably made from tungsten carbide-based cemented carbide substrate and a hard coating layer.

A hard coating layer preferably covers a part of the surface, more preferably the entire surface of the substrate tool. The hard coating layer of this invention has a total thickness of from 0.5 to 20 $\mu$m, and is preferably made of alternating multilayer structures of the first thin layer and the second thin layer whose individual thicknesses are from 0.01 to 0.3 $\mu$m, and the first thin layer is made of titanium compounds and the second thin layer is made of hard oxide materials, the first thin layer is preferably selected from the group of TiC, TiCN and TiN, and the second thin layer is preferably selected from $Al_2O_3$ and $HfO_2$.

The preferred embodiments of the present invention were determined after testing many kinds of hard coating layers on cemented carbide cutting tool substrates with the view to developing new long tool lifetime coated carbide members, even when they are applied to extremely severe cutting operations such as high-speed cutting operations with thick depth-of-cut, high-speed cutting operations with high feed rate, interrupted cutting operations at high-speed which cause severe mechanical and thermal impacts at the cutting edge. From these tests, the following results (A) through (C) were found.

(A) First, it was determined to use a Ti compound layer and a hard oxide material layer as the constituents of a hard coating layer of the target coated carbide member because they are indispensable due to their excellent characteristics such as extremely high hardness and extremely prominent thermal properties. The candidates for the Ti compound layer and the hard oxide material layer were TiC, TiN, TiCN, TiCO, TiCNO, and $Al_2O_3$, $ZrO_2$, $HfO_2$, respectively.

Hard coating layer with an alternating multilayer structure has an advantage in that each of the individual thin layers always performs with full play simultaneously and equally against the work materials because each constituent layer simultaneously participates at the contacting point with the work materials.

When an alternating multilayer structure comprising a first thin layer of a Ti compound and a second thin layer of a hard oxide material is coated as a hard coating layer, the coated carbide member exhibits improved cutting performance, wherein the occurrence of breakage or chipping at the cutting edge was considerably reduced even used in extremely tough cutting operations for workpiece materials such as those of steel and cast iron. These results were considered to occur because the performances of the first thin layer with superior wear resistance and toughness and the second thin layer with superior high temperature characteristics were always executed in full playing simultaneously and equally against the work materials. Favorable materials for the first thin layer are TiC, TiCN, and TiN. Favorable materials for the second thin layer are $Al_2O_3$ and $HfO_2$.

(B) When the thickness of the individual constituent layer is set to 0.01 to 0.3 $\mu$m, the effect of the alternating multilayer structure further improved, and then the cutting performance of the resultant coated carbide member also further improved.

(C) Furthermore, very interesting results were obtained when the thickness of the individual constituent layer of the alternated multilayer structure was set to between 0.01 to 0.3 $\mu$m and also the thickness ratio of the second thin layer to the first thin layer was set to between 2 to 4, the cutting performance of the coated carbide member become surprisingly superior even when used for extremely tough cutting operations such as high-speed cutting operations with thick depth-of-cut, high-speed cutting operations with high feed rate, and interrupted cutting operations at high-speed, of steel and cast iron.

(D) Under conditions in which the layers composing the hard coating layer of the cemented coated carbide cutting tool are specified to be a TiN layer and a κ-type $Al_2O_3$ layer, these layers are layered as two alternating multiple layers, the average thickness of the TiN layer in these layers is as thin as 0.01 to 0.1 $\mu$m, the ratio of above-mentioned TiN layer in the hard coating layer is set to be 70 to 95 weight %, when hard coating layers of which the total average thickness is 0.8 to 10 $\mu$m is formed, and such a hard coating layer has superior chipping resistance due to the TiN layer having properties such as high toughness of the respective thin layers because of the thin layered alternating multiple layered structure of the above-mentioned two thin layers and superior abrasion resistance due to the κ-type $Al_2O_3$ layer having heat resistance, and as a result, the cemented coated carbide cutting tool exhibits superior abrasion resistance over a long period without causing chipping at the cutting edge, even if heavy cutting operations are performed particularly on steel and cast iron.

(E) Under conditions in which the layers composing the hard coating layer of the cemented coated carbide cutting tool is specified to be a κ-type $Al_2O_3$ layer and a TiN layer, these layers are layered as two alternating multiple layers, the average thickness of κ-type $Al_2O_3$ layer in these layers are as thin as 0.01 to 0.1 $\mu$m, the ratio of above mentioned κ-type $Al_2O_3$ layer in the hard coating layer is set to be 60 to 95 weight %, and when hard coating layers of which total average thickness is 0.8 to 10 $\mu$m is formed, such a hard coating layer has superior thermal plasticity transformation resistance as a result of the κ-type $Al_2O_3$ layer having superior heat resistance and the TiN layer having superior toughness, and as a result, in the cemented coated carbide cutting tool, there is no occurrence of chipping at the cutting edge, and also the occurrence of thermal plasticity transformation is restricted; thus, the tool exhibits superior abrasion resistance for a long time even if high speed cutting operations which cause the generation of high heat on steel and cast iron is performed.

(F) Under conditions in which the layers composing the hard coating layer of the cemented coated carbide cutting tool are specified to be a TiN layer and a κ-type $Al_2O_3$ layer, these layers are layered as two alternating multiple layers, the average thickness of the TiN layer in these layers are as thin as 0.01 to 0.1 $\mu$m, the ratio of the above-mentioned TiN layer in the hard coating layer is set to be 41 to 69 weight %, when hard coating layers of which total average thickness is 0.8 to 10 $\mu$m are formed, such a hard coating layer has superior chipping resistance due to the TiN layer having properties such as high toughness of the respective thin layer because of the thin layered alternating multiple layered structure of the above-mentioned two thin layers and superior abrasion resistance due to the κ-type $Al_2O_3$ layer having heat resistance, and as a result, the cemented coated carbide cutting tool exhibits superior abrasion resistance over a long period without causing chipping on cutting edge even if high speed interrupted cutting operations which cause high mechanical and thermal impacts on steel and cast iron are performed.

(G) Under conditions in which the layers composing the hard coating layer of the cemented coated carbide cutting tool are specified to be a TiCN layer and a$Al_2O_3$ layer, these layers are layered as two alternating multiple layers, the average thickness of these layers are as thin as 0.01 to 0.1 μm, and the total average thickness of the layer is made 0.8 to 10 μm, and as a result, such hard coating layers are in thin layered alternating multiple layered structure, the TiCN layer and the $Al_2O_3$ layer are directly involved simultaneously in the cutting operation to the workpiece, the properties of the tools, such as toughness of the TiCN layer and the heat resistance of the $AL_2O_3$, are exhibited without chronic change, and thus, as a result, the cemented coated carbide cutting tools exhibits superior abrasion resistance over a long period without the occurrence of chipping on the hard coating layer even if the tool is used in high speed interrupted cutting operations on steel and cast iron which causes high mechanical and thermal impacts.

(H) Under conditions in which the layers composing the hard coating layer of the cemented coated carbide cutting tool is specified to be a TiN layer and/or a TiCN layer and a $HfO_2$ layer, these layers are layered as two alternating multiple layers, the average thickness of these layers are as thin as 0.01 to 0.1 μm, and the total average thickness of the layer is made 0.8 to 10 μm, and as a result, such hard coating layers are in a thin layered alternating multiple layered structure, the TiNC layer and the $HfO_2$ are directly involved simultaneously in the cutting operation to the workpiece, the properties of the tools such as toughness of the TiNC layer and the heat resistance (Heat conductivity of $HfO_2$ is 1.2 W/mK) of the $HfO_2$ are exhibited without chronic change, and thus, as a result, the cemented coated carbide cutting tools exhibits superior abrasion resistance for a long time without the occurrence of chipping at the hard coating layer, even if the tool is used in high speed cutting operations on steel and cast iron which causes high heat generation, the hard coating layer shields the high heat, to prevent the carbide base from receiving the influence of heat, and thus, the generation of thermal plasticity transformation at the cutting edge as a cause of the partial wear; thus, the superior abrasion resistance is exhibited for a long time.

(I) Under conditions in which the layers composing the hard coating layer of the cemented coated carbide cutting tool is specified to be the TiN layer and/or the TiCN layer and the $HfO_2$ layer, these layers are layered as two alternating multiple layers, average thickness of these layers are as thin as 0.25 to 0.75 μm, and the total number of layers of these layer is set to be 4 to 9 layers, and the average thickness of the layer is made 1 to 6 μm, and as a result, such hard coating layers are in a thin layered alternating multiple layered structure, the TiN and/or TICN layer and the $HfO_2$ are directly involved simultaneously in the cutting operation on the workpiece, property of the tools such as toughness of the TiN layer and the heat resistance (heat conductivity of $HfO_2$ is 1.2 W/mK) of the $HfO_2$ are exhibited without chronic change, and thus, as a result, the cemented coated carbide cutting tools shows superior abrasion resistance over a long period without the occurrence of chipping at the hard coating layer even if the tool is used in high speed cutting operation for the steel and cast iron which causes high heat generation, the hard coating layer blocks the high heat, to prevent the carbide base from receiving the influence of heat, and thus, the generation of thermal plasticity transformation on the cutting edge as a cause of the partial wear; thus, the superior abrasion resistance is exhibited over a long period.

(J) Under conditions in which the layers composing the hard coating layer of the cemented coated carbide cutting tool is specified to be the TiN layer and/or the TiCN layer and the $Al_2O_3$ layer, these layers are layered as alternating multiple layers, the average thickness of these layers are as thin as 0.25 to 0.75 μm, and the total number of layers of these layer is set to be 4 to 9 layers, and the average thickness of the layer is made 1 to 6 μm, and as a result, such hard coating layers are in a thin layered alternating multiple layered structure, the TiN and/or TiCN layer and the $Al_2O_3$ are directly involved simultaneously in the cutting operation of the workpiece, the properties of the tools such as toughness of the TiN and/or TiCN layer and the heat resistance of the $Al_2O_3$ are exhibited without chronic change, and thus, as a result, the cemented coated carbide cutting tools exhibits superior abrasion resistance for a long time without the occurrence of chipping on the hard coating layer even if the tool is used in high speed interrupted cutting operation on steel and cast iron which causes high mechanical and thermal impacts.

Based on these results, the present invention provides for coated carbide member that exhibits superior performance against breakage and chipping of the cutting edge for a long period of time during severe cutting operations on steel and cast iron because of its excellent toughness of the hard coating layer by providing a coated carbide member preferably composed of a cemented carbide substrate and a hard coating layer preferably having an average thickness of 0.5 to 20 μm formed on the substrate being composed of an alternating multilayer structure of the first thin layer and the second thin layer whose individual thickness is between 0.01 to 0.3 μm, and the first thin layer is made of titanium compounds and the second thin layer is made of hard oxide materials, the first thin layer is preferably selected from the group of TiC, TiCN and TiN, and the second thin layer is selected from $Al_2O_3$ and $HfO_2$.

In the present invention, the average thickness of the hard coating layer is preferably 0.5 to 20 μm. Excellent wear resistance cannot be achieved at a thickness of less than 0.5 μm, whereas breakage and chipping at the cutting edge of the cutting tool member are apt to occur at a thickness of over 20 μm even though the hard coating layer is constructed with an alternating multi-layer structure.

The average thickness of the each thin layer is preferably set to 0.01 to 0.3 μm. Satisfactory intrinsic characteristics such as high wear resistance for the first thin layer and high temperature properties for the second thin layer cannot be achieved at a thickness of less than 0.01 μm, whereas intrinsic drawbacks of each constituent thin layer such as a drop in layer toughness due to grain growth becomes prominent at more than 0.3 μm.

Having generally described this invention, a further understanding can be obtained by reference to certain specific examples that are provided herein for purposes of illustration only and are not intended to be limiting unless otherwise specified.

Embodiment 1

The following powders, each having an average grain size in a range from 1 and 3 μm, were prepared as raw materials for substrates: WC powder, TiC powder, ZrC powder, VC powder, TaC powder, NbC powder, $Cr_3C_2$ powder, TiN powder, TaN powder and Co powder. Those powders were compounded based on the formulation shown in Table 1, wet-mixed with an addition of wax and acetone solution in a ball mill for 24 hours and were dried under reduced pressure. Dried mixed powder was compressed at a pressure of 98 MPa to form a green compact, which was sintered under the following conditions: a pressure of 5 Pa, a temperature of 1370 to 1470° C., and a holding duration of 1 hour, to manufacture cemented carbide insert substrates A through J defined in ISO-CNMG120408.

The cutting edges of the cemented carbide insert substrates A through J were subjected to honing with a radius of 0.07 mm followed by ultrasonic washing in an acetone solution. After careful drying, each substrate was subjected to conditions in a conventional chemical vapor deposition apparatus and was subjected to the hard coating layer coating with alternating multilayer structure; each thickness of the individual thin layers, alternating cycles, and the total thicknesses are shown in Table 3 using the deposition conditions shown in Table 2. Purging status with $H_2$ gas every 30 seconds was always inserted between the depositions of the first thin layer and the second thin layer. Coated cemented carbide inserts in accordance with the present invention 1 through 10 were manufactured in such a manner.

To manufacture conventional coated cemented carbide inserts for comparison, the same substrates were used and were subjected to hard coating layer whose structures and thicknesses are shown in Table 5 using the deposition conditions shown in Table 4. Conventional coated cemented carbide inserts 1 through 10 were manufactured in such a manner.

From the investigation of the hard coating layers using an optical microscope and a scanning electron microscope, the thickness of each layer was almost identical to the designed thickness.

Furthermore, for coated cemented carbide inserts of the present invention 1 through 10 and conventional coated cemented carbide inserts 1 through 10, the following cutting tests were conducted. A wear width on the flank face was measured in each test. The results are shown in Table 6.

(1-1) Cutting Style: Interrupted Turning of Alloyed Steel

Workpiece: JIS SCM415 round bar having 4 longitudinal grooves

Cutting speed: 330 m/min.

Feed rate: 0.2 mm/rev.

Depth of cut: 2 mm

Cutting time: 3 min.

Coolant: Dry (1-2) Cutting Style: Interrupted Turning of Cast Iron

Work piece: JIS FC300 round bar having 4 longitudinal grooves

Cutting speed: 330 m/min.

Feed rate: 0.25 mm/rev.

Depth of cut: 2 mm

Cutting time: 3 min.

Coolant: Dry

Embodiment 2

The cutting edges of the cemented carbide insert substrates A through J were subjected to honing with the radius of 0.07 mm followed by the ultrasonic washing in an acetone solution. After careful drying, each substrate was subjected to be in the conventional chemical vapor deposition apparatus and subjected to the hard coating layer with alternated multilayer structure, each thickness of individual thin layer, alternating cycles and the total thickness are shown in Table 7 using the deposition conditions shown in Table 2. Purging status with $H_2$ gas for 30 seconds was always inserted between the depositions of the first thin layer and the second thin layer. Coated cemented carbide inserts in accordance with the present invention 11 through 20 were manufactured in such a manner.

To manufacture conventional coated cemented carbide inserts for reference, the same substrates were used, and subjected to hard coating layer having structure and thickness is shown in Table 8 using the deposition conditions shown in Table 4. Conventional coated cemented carbide inserts 11 through 20 were manufactured in such a manner.

From the investigation of the hard coating layers using optical microscope and scanning electron microscope, the thickness of each layer was almost identical to the designed thickness.

Further, for coated cemented carbide inserts of the present invention 11 through 20 and conventional coated cemented carbide inserts 11 through 20, the following cutting tests were conducted. A wear width on the flank face was measured in each test. The results are shown in Table 9.

(2-1) Cutting Style: Interrupted Turning of Alloyed Steel

Work piece: JIS SCM415 round bar having 4 longitudinally grooves

Cutting speed: 350 m/min.

Feed rate: 0.2 mm/rev.

Depth of cut: 2 mm

Cutting time: 3 min.

Coolant: Dry (2-2) Cutting Style: Interrupted Turning of Cast Iron

Work piece: JIS FC300 round bar having 4 longitudinally grooves

Cutting speed: 350 m/min.

Feed rate: 0.25 mm/rev.

Depth of cut: 2 mm

Cutting time: 3 min.

Coolant: Dry

Embodiment 3

The cutting edges of the cemented carbide insert substrates A through J were subjected to honing with the radius of 0.10 mm followed by the ultrasonic washing in an acetone solution. After careful drying, each substrate was subjected to the conventional chemical vapor deposition apparatus and subjected to the hard coating layer with alternating multilayer structure, each thickness of individual thin layer, alternating cycles and the total thickness are shown in Table 11 using the deposition conditions shown in Table 10. Purging status with $H_2$ gas for 30 seconds was always inserted between the depositions of the first thin layer and the second thin layer. Coated cemented carbide inserts in accordance with the present invention 21 through 30 were manufactured in such a manner.

To manufacture conventional coated cemented carbide inserts for reference, the same substrates were used, and subjected to hard coating layer whose structure and thickness is shown in Table 12 using the deposition conditions shown in Table 4. Conventional coated cemented carbide inserts 21 through 30 were manufactured in such a manner.

From the investigation of the hard coating layers using optical microscope and scanning electron microscope, the thickness of each layer was almost identical to the designed thickness.

Further, for coated cemented carbide inserts of the present invention 21 to 30 and conventional coated cemented carbide inserts 21 to 30, the following cutting tests were conducted. A wear width on the flank face was measured in each test. The results are shown in Table 13.

(3-1) Cutting Style: Continuous Turning of Alloyed Steel with Thick Depth-of-cut Work piece: JIS SCM415 round bar Cutting speed: 180 m/min.

Feed rate: 0.45 mm/rev.

Depth of cut: 7 mm

Cutting time: 5 min.

Coolant: Dry (3-2) Cutting Style: Interrupted Turning of Alloyed Steel with High Feed Rate Work piece: JIS SCM415 round bar having 4 longitudinally grooves Cutting speed: 150 m/min.

Feed rate: 0.7 mm/rev.

Depth of cut: 4 mm

Cutting time: 3 min.

Coolant: Dry

Embodiment 4

The cutting edges of the cemented carbide insert substrates A through J were subjected to honing with the radius of 0.03 mm followed by the ultrasonic washing in an acetone solution. After careful drying, each substrate was subjected to be in the conventional chemical vapor deposition apparatus and subjected to the hard coating layer with alternated multilayer structure, each thickness of individual thin layer, alternating cycles and the total thickness are shown in Table 14 using the deposition conditions shown in Table 10. Purging status with $H_2$ gas for 30 seconds was always inserted between the depositions of the first thin layer and the second thin layer. Coated cemented carbide inserts in accordance with the present invention 31 through 40 were manufactured in such a manner.

To manufacture conventional coated cemented carbide inserts for reference, the same substrates were used, and subjected to coat hard coating layer whose structure and thickness is shown in Table 15 using the deposition conditions shown in Table 4. Conventional coated cemented carbide inserts 31 through 40 were manufactured in such a manner.

From the investigation of the hard coating layers using optical microscope and scanning electron microscope, the thickness of each layer was almost identical to the designed thickness.

Further, for coated cemented carbide inserts of the present invention 31 through 40 and conventional coated cemented carbide inserts 31 through 40, the following cutting tests were conducted. A wear width on the flank face was measured in each test. The results are shown in Table 16.

(4-1) Cutting Style: Continuous Turning of Alloyed Steel

Work piece: JIS SCM440 round bar

Cutting speed: 350 m/min.

Feed rate: 0.2 mm/rev.

Depth of cut: 2 mm

Cutting time: 5 min.

Coolant: Dry (4-2) Cutting Style: Interrupted Turning of Stainless Steel

Work piece: JIS SUS304 round bar having 4 longitudinally grooves

Cutting speed: 200 m/min.

Feed rate: 0.2 mm/rev.

Depth of cut: 1.5 mm

Cutting time: 3 min.

Coolant: Dry

Embodiment 5

The cutting edges of the cemented carbide insert substrates A through J were subjected to honing with the radius of 0.07 mm followed by the ultrasonic washing in an acetone solution. After careful drying, each substrate was subjected to be in the conventional chemical vapor deposition apparatus and subjected to the hard coating layer with alternating multilayer structure, each thickness of individual thin layer, alternating cycles and the total thickness are shown in Table 17 using the deposition conditions shown in Table 10. Purging status with $H_2$ gas for 30 seconds was always inserted between the depositions of the first thin layer and the second thin layer. Coated cemented carbide inserts in accordance with the present invention 41 to 50 were manufactured in such a manner.

To manufacture conventional coated cemented carbide inserts for reference, the same substrates were used, and subjected to hard coating layer whose structure and thickness is shown in Table 18 using the deposition conditions shown in Table 4. Conventional coated cemented carbide inserts 41 through 50 were manufactured in such a manner.

From the investigation of the hard coating layers using optical microscope and scanning electron microscope, the thickness of each layer was almost identical to the designed thickness.

Further, for coated cemented carbide inserts of the present invention 41 through 50 and conventional coated cemented carbide inserts 41 through 50, the following cutting tests were conducted. A wear width on the flank face was measured in each test. The results are shown in Table 19.

(5-1) Cutting Style: Interrupted Turning of Alloyed Steel

Work piece: JIS SCM415 round bar having 4 longitudinally grooves

Cutting speed: 330 m/min.

Feed rate: 0.25 mm/rev.

Depth of cut: 2 mm

Cutting time: 3 min.

Coolant: Dry (5-2) Cutting Style: Interrupted Turning of Cast Iron

Work piece: JIS FC300 round bar having 4 longitudinally grooves

Cutting speed: 350 m/min.

Feed rate: 0.3 mm/rev.

Depth of cut: 2 mm

Cutting time: 3 min.

Coolant: Dry

Embodiment 6

The cutting edges of the cemented carbide insert substrates A through J were subjected to honing with the radius of 0.07 mm followed by the ultrasonic washing in an acetone solution. After careful drying, each substrate was subjected to be in the conventional chemical vapor deposition apparatus and subjected to coat the hard coating layer with alternating multilayer structure, each thickness of individual thin layer, alternating cycles and the total thickness are shown in Table 21 using the deposition conditions shown in Table 20. Purging status with $H_2$ gas for 30 seconds was always inserted between the depositions of the first thin layer and the second thin layer. Coated cemented carbide inserts in accordance with the present invention 51 through 60 were manufactured in such a manner.

To manufacture conventional coated cemented carbide inserts for reference, the same substrates were used, and subjected to hard coating layer whose structure and thickness is shown in Table 22 using the deposition conditions shown in Table 4. Conventional coated cemented carbide inserts 51 through 60 were manufactured in such a manner.

From the investigation of the hard coating layers using optical microscope and scanning electron microscope, the thickness of each layer was almost identical to the designed thickness.

Furthermore, for coated cemented carbide inserts of the present invention 51 to 60 and conventional coated cemented carbide inserts 51 through 60, the following cutting tests were conducted. A wear width on the flank face was measured in each test. The results are shown in Table 23.

(6-1) Cutting Style: Continuous Turning of Alloyed Steel

Work piece: JIS SCM440 round bar

Cutting speed: 450 m/min.

Feed rate: 0.2 mm/rev.

Depth of cut: 1.5 mm

Cutting time: 5 min.

Coolant: Dry (6-2) Cutting Style: Interrupted Turning of Stainless Steel

Work piece: JIS SUS304 round bar having 4 longitudinally grooves

Cutting speed: 250 m/min.

Feed rate: 0.2 mm/rev.

Depth of cut: 1.5 mm

Cutting time: 3 min.

Coolant: Dry

Embodiment 7

The cutting edges of the cemented carbide insert substrates A to J were subjected to honing with the radius of 0.07 mm followed by the ultrasonic washing in an acetone solution. After careful drying, each substrate was subjected to be in the conventional chemical vapor deposition apparatus and subjected to the hard coating layer with alternated multilayer structure, each thickness of individual thin layer, alternating cycles and the total thickness are shown in Table 24 using the deposition conditions shown in Table 20. Purging status with $H_2$ gas for 30 seconds was always inserted between the depositions of the first thin layer and the second thin layer. Coated cemented carbide inserts in accordance with the present invention 61 through 70 were manufactured in such a manner.

To manufacture conventional coated cemented carbide inserts for reference, the same substrates were used, and subjected to hard coating layer whose structure and thickness is shown in Table 25 using the deposition conditions shown in Table 4. Conventional coated cemented carbide inserts 61 through 70 were manufactured in such a manner.

From the investigation of the hard coating layers using optical microscope and scanning electron microscope, the thickness of each layer was almost identical to the designed thickness.

Furthermore, for coated cemented carbide inserts of the present invention 61 through 70 and conventional coated cemented carbide inserts 61 through 70, the following cutting tests were conducted. A wear width on the flank face was measured in each test. The results are shown in Table 26.

(7-1) Cutting Style: Continuous Turning of Alloyed Steel

Work piece: JIS SCM440 round bar

Cutting speed: 420 m/min.

Feed rate: 0.25 mm/rev.

Depth of cut: 1.5 mm

Cutting time: 5 min.

Coolant: Dry (7-2) Cutting Style: Interrupted Turning of Stainless Steel

Work piece: JIS SUS304 round bar having 4 longitudinally grooves

Cutting speed: 230 m/min.

Feed rate: 0.2 mm/rev.

Depth of cut: 1.5 mm

Cutting time: 3 min.

Coolant: Dry

TABLE 1

| CARBIDE SUBSTRATE | COMPOSITION (wt %) Co | TiC | ZrC | VC | TaC | NbC | Cr3C2 | TiN | TaN | WC |
|---|---|---|---|---|---|---|---|---|---|---|
| A | 10.5 | 8 | — | — | 8 | 1.5 | — | — | — | BALANCE |
| B | 7 | — | — | — | — | — | — | — | — | BALANCE |
| C | 5.7 | — | — | — | 1.5 | 0.5 | — | — | — | BALANCE |
| D | 5.7 | — | — | — | — | — | 1 | — | — | BALANCE |
| E | 8.5 | — | 0.5 | — | — | — | 0.5 | — | — | BALANCE |
| F | 9 | — | — | — | 2.5 | 1 | — | — | — | BALANCE |
| G | 9 | 8.5 | — | — | 8 | 3 | — | — | — | BALANCE |
| H | 11 | 8 | — | — | 4.5 | — | — | 1.5 | — | BALANCE |
| I | 12.5 | 2 | — | — | — | — | — | 1 | 2 | BALANCE |
| J | 14 | — | — | 0.2 | — | — | — | — | — | BALANCE |

TABLE 2

| HARD COATING LAYER | COMPOSITION OF REACTIVE GAS (volume %) | AMBIENCE PRESSURE (kPa) | AMBIENCE TEMPERATURE (° C.) |
|---|---|---|---|
| TiN | $TiCl_4$: 4.2%, $N_2$: 30%, $H_2$: BALANCE | 25 | 980 |
| TiCN | $TiCl_4$: 4.2%, $N_2$: 20%, $CH_4$: 4%, $H_2$: BALANCE | 7 | 980 |
| α-$Al_2O_3$ | $AlCl_3$: 2.2%, $CO_2$: 5.5%, HCl: 2.2%, $H_2S$: 0.2%, $H_2$: BALANCE | 7 | 980 |
| κ-$Al_2O_3$ | $AlCl_3$: 3.3%, $CO_2$: 4%, HCl: 2.2%, $H_2S$: 0.3%, $H_2$: BALANCE | 7 | 980 |

TABLE 3

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER | 6th LAYER | 7th LAYER | 8th LAYER | 9th LAYER | TOTAL THICKNESS |
|---|---|---|---|---|---|---|---|---|---|---|---|---|
| THIS INVENTION | 1 | A | TiN (0.25) | κ-$Al_2O_3$ (0.25) | TiN (0.25) | κ-$Al_2O_3$ (0.25) | — | — | — | — | — | 1.0 |
| | 2 | B | TiCN (0.5) | α-$Al_2O_3$ (0.5) | TiCN (0.5) | α-$Al_2O_3$ (0.5) | TiCN (0.5) | α-$Al_2O_3$ (0.5) | — | — | — | 3.0 |
| | 3 | C | TiN (0.25) | α-$Al_2O_3$ (0.25) | TiN (0.25) | α-$Al_2O_3$ (0.25) | TiN (0.25) | α-$Al_2O_3$ (0.25) | — | — | — | 1.5 |
| | 4 | D | TiN (0.5) | κ-$Al_2O_3$ (0.75) | TiCN (0.5) | κ-$Al_2O_3$ (0.75) | TiN (0.5) | — | — | — | — | 3.0 |
| | 5 | E | TiCN (0.75) | α-$Al_2O_3$ (0.75) | TiCN (0.5) | κ-$Al_2O_3$ (0.75) | TiCN (0.5) | α-$Al_2O_3$ (0.75) | TiN (0.5) | — | — | 4.5 |
| | 6 | F | TiN (0.6) | κ-$Al_2O_3$ (0.4) | TiCN (0.6) | κ-$Al_2O_3$ (0.4) | TiN (0.6) | κ-$Al_2O_3$ (0.4) | TiCN (0.6) | κ-$Al_2O_3$ (0.4) | — | 4.0 |
| | 7 | G | TiCN (0.75) | α-$Al_2O_3$ (0.5) | TiCN (0.5) | α-$Al_2O_3$ (0.5) | TiCN (0.5) | α-$Al_2O_3$ (0.5) | TiCN (0.5) | α-$Al_2O_3$ (0.5) | TiCN (0.5) | 4.8 |
| | 8 | H | TiN (0.6) | κ-$Al_2O_3$ (0.3) | TiN (0.45) | κ-$Al_2O_3$ (0.45) | TiN (0.3) | κ-$Al_2O_3$ (0.6) | TiN (0.3) | — | — | 3.0 |
| | 9 | I | TiCN (0.75) | α-$Al_2O_3$ (0.25) | TiN (0.5) | α-$Al_2O_3$ (0.25) | TiCN (0.5) | α-$Al_2O_3$ (0.25) | — | — | — | 2.5 |
| | 10 | J | TiN (0.7) | α-$Al_2O_3$ (0.7) | TiCN (0.7) | κ-$Al_2O_3$ (0.7) | TiN (0.7) | α-$Al_2O_3$ (0.7) | TiCN (0.7) | κ-$Al_2O_3$ (0.7) | TiN (0.4) | 6.0 |

TABLE 4

| HARD COATING LAYER | COMPOSITION OF REACTIVE GAS (volume %) | AMBIENCE PRESSURE (kPa) | AMBIENCE TEMPERATURE (° C.) |
|---|---|---|---|
| TiC | $TiCl_4$: 4.2%, $CH_4$: 8.5%, $H_2$: BALANCE | 7 | 1020 |
| TiN (1st LAYER) | $TiCl_4$: 4.2%, $N_2$: 30%, $H_2$: BALANCE | 20 | 900 |
| TiN (OTHERS) | $TiCl_4$: 4.2%, $N_2$: 35%, $H_2$: BALANCE | 25 | 1040 |
| TiCN | $TiCl_4$: 4.2%, $N_2$: 20%, $CH_4$: 4%, $H_2$: BALANCE | 7 | 1020 |
| l-TiCN | $TiCl_4$: 4.2%, $N_2$: 30%, $CH_3CN$: 1%, $H_2$: BALANCE | 7 | 900 |
| TiCO | $TiCl_4$: 4.2%, CO: 3%, $H_2$: BALANCE | 7 | 1020 |

TABLE 4-continued

| HARD COATING LAYER | COMPOSITION OF REACTIVE GAS (volume %) | AMBIENCE PRESSURE (kPa) | AMBIENCE TEMPERATURE (° C.) |
|---|---|---|---|
| TiCNO | $TiCl_4$: 4.2%, CO: 3%, $CH_4$: 3%, $N_2$: 20%, $H_2$: BALANCE | 15 | 1020 |
| α-$Al_2O_3$ | $AlCl_3$: 2.2%, $CO_2$: 5.5%, HCl: 2.2%, $H_2S$: 0.2%, $H_2$: BALANCE | 7 | 1000 |
| κ-$Al_2O_3$ | $AlCl_3$: 3.3%, $CO_2$: 5%, HCl: 2.2%, $H_2S$: 0.2%, $H_2$: BALANCE | 7 | 950 |

l-TiCN represents TiCN layer having longitudinal crystal structure

TABLE 5

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| CONVENTIONAL | 1 | A | TiN (0.2) | TiCN (0.5) | TiCNO (0.1) | κ-$Al_2O_3$ (0.2) | — |
| | 2 | B | TiC (0.5) | TiCN (1.5) | TiCO (0.2) | α-$Al_2O_3$ (0.8) | — |
| | 3 | C | TiCN (0.5) | α-$Al_2O_3$ (1) | — | — | — |
| | 4 | D | TiC (0.3) | TiCN (1.5) | TiC (0.5) | TiCN (0.2) | κ-$Al_2O_3$ (0.5) |
| | 5 | E | TiCN (0.5) | TiC (2) | TiN (0.3) | κ-$Al_2O_3$ (1.7) | — |
| | 6 | F | TiN (1.5) | TiCNO (0.3) | α-$Al_2O_3$ (2.2) | — | — |
| | 7 | G | TiC (1) | TiCO (1) | TiCN (2) | TiCNO (0.3) | α-$Al_2O_3$ (0.5) |

TABLE 5-continued

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| | 8 | H | TiCN (2) | κ-$Al_2O_3$ (1) | — | — | — |
| | 9 | I | TiN (0.3) | TiCN (0.7) | κ-$Al_2O_3$ (1.5) | — | — |
| | 10 | J | TiN (1) | TiCN (2) | TiN (0.7) | TiCNO (0.3) | κ-$Al_2O_3$ (2) |

TABLE 6

| INSERT | | FLANK WEAR (mm) INTERRUPTED TURNING OF ALLOYED STEEL | INTERRUPTED TURNING OF CAST IRON | INSERT | | FLANK WEAR (mm) INTERRUPTED TURNING OF ALLOYED STEEL | INTERRUPTED TURNING OF CAST IRON |
|---|---|---|---|---|---|---|---|
| THIS INVENTION | 1 | 0.34 | 0.37 | CONVENTIONAL | 1 | FAILURE AT 2.0 min. | FAILURE AT 1.6 min. |
| | 2 | 0.27 | 0.33 | | 2 | FAILURE AT 1.7 min. | FAILURE AT 1.1 min. |
| | 3 | 0.30 | 0.34 | | 3 | FAILURE AT 1.5 min. | FAILURE AT 2.3 min. |
| | 4 | 0.29 | 0.28 | | 4 | FAILURE AT 1.9 min. | FAILURE AT 1.8 min. |
| | 5 | 0.29 | 0.29 | | 5 | FAILURE AT 0.8 min. | FAILURE AT 1.5 min. |
| | 6 | 0.27 | 0.32 | | 6 | FAILURE AT 0.9 min. | FAILURE AT 1.0 min. |
| | 7 | 0.31 | 0.30 | | 7 | FAILURE AT 1.4 min. | FAILURE AT 1.4 min. |
| | 8 | 0.30 | 0.35 | | 8 | FAILURE AT 2.1 min. | FAILURE AT 0.7 min. |
| | 9 | 0.28 | 0.31 | | 9 | FAILURE AT 1.8 min. | FAILURE AT 1.5 min. |
| | 10 | 0.25 | 0.27 | | 10 | FAILURE AT 1.6 min. | FAILURE AT 0.9 min. |

All failures were caused by chipping occurred at cutting edge

TABLE 7

| INSERT | | SUBSTRATE | HARD COATING LAYER INDIVIDUAL 1ST THIN LAYER (μm) | INDIVIDUAL 2nd THIN LAYER (μm) | NUMBER OF ALTERNATED LAYERS | TOTAL THICKNESS (μm) |
|---|---|---|---|---|---|---|
| THIS INVENTION | 1 | A | TiCN (0.05) | κ-$Al_2O_3$ (0.05) | 120 | 6.0 |
| | 2 | B | TiCN (0.03) | α-$Al_2O_3$ (0.07) | 100 | 5.0 |
| | 3 | C | TiCN (0.1) | κ-$Al_2O_3$ (0.1) | 30 | 3.0 |
| | 4 | D | TiCN (0.01) | α-$Al_2O_3$ (0.05) | 120 | 3.6 |
| | 5 | E | TiCN (0.08) | κ-$Al_2O_3$ (0.08) | 100 | 8.0 |
| | 6 | F | TiCN (0.1) | α-$Al_2O_3$ (0.05) | 120 | 9.0 |
| | 7 | G | TiCN (0.05) | κ-$Al_2O_3$ (0.1) | 130 | 9.8 |
| | 8 | H | TiCN (0.02) | κ-$Al_2O_3$ (0.05) | 24 | 0.85 |
| | 9 | I | TiCN (0.04) | α-$Al_2O_3$ (0.1) | 50 | 3.5 |
| | 10 | J | TiCN (0.01) | α-$Al_2O_3$ (0.02) | 500 | 7.5 |

TABLE 8

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| CONVENTIONAL | 1 | A | TiN (0.2) | TiCNO (0.2) | κ-$Al_2O_3$ (4) | — | — |
| | 2 | B | TiCN (0.5) | TiCO (0.3) | α-$Al_2O_3$ (5) | — | — |
| | 3 | C | TiC (1.2) | κ-$Al_2O_3$ (1.8) | — | — | — |
| | 4 | D | TiN (0.3) | TiCNO (0.3) | α-$Al_2O_3$ (2.5) | — | — |
| | 5 | E | TiN (0.3) | TiC (1) | TiCNO (0.3) | κ-$Al_2O_3$ (5) | — |
| | 6 | F | TiN (1) | TiCN (3) | α-$Al_2O_3$ (3.5) | — | — |
| | 7 | G | TiN (0.5) | TiC (5) | TiCN (0.4) | TiCO (0.1) | κ-$Al_2O_3$ (4) |
| | 8 | H | TiN (0.2) | TiC (0.2) | κ-$Al_2O_3$ (0.4) | — | — |
| | 9 | I | TiC (1) | TiCNO (0.2) | α-$Al_2O_3$ (2) | — | — |
| | 10 | J | TiCN (1) | TiC (3.8) | TiCNO (0.3) | α-$Al_2O_3$ (3) | — |

TABLE 9

| INSERT | | FLANK WEAR (mm) INTERRUPTED TURNING OF ALLOYED STEEL | INTERRUPTED TURNING OF CAST IRON | INSERT | | FLANK WEAR (mm) INTERRUPTED TURNING OF ALLOYED STEEL | INTERRUPTED TURNING OF CAST IRON |
|---|---|---|---|---|---|---|---|
| THIS INVENTION | 1 | 0.24 | 0.32 | CONVENTIONAL | 1 | FAILURE AT 1.5 min. | FAILURE AT 0.9 min. |
| | 2 | 0.21 | 0.26 | | 2 | FAILURE AT 1.9 min. | FAILURE AT 2.1 min. |
| | 3 | 0.31 | 0.33 | | 3 | FAILURE AT 0.3 min. | FAILURE AT 0.7 min. |
| | 4 | 0.28 | 0.28 | | 4 | FAILURE AT 0.7 min. | FAILURE AT 2.4 min. |
| | 5 | 0.28 | 0.31 | | 5 | FAILURE AT 1.1 min. | FAILURE AT 1.1 min. |
| | 6 | 0.25 | 0.24 | | 6 | FAILURE AT 0.9 min. | FAILURE AT 1.9 min. |
| | 7 | 0.30 | 0.29 | | 7 | FAILURE AT 1.2 min. | FAILURE AT 0.6 min. |
| | 8 | 0.22 | 0.33 | | 8 | FAILURE AT 0.6 min. | FAILURE AT 0.4 min. |
| | 9 | 0.24 | 0.27 | | 9 | FAILURE AT 0.6 min. | FAILURE AT 1.8 min. |
| | 10 | 0.32 | 0.28 | | 10 | FAILURE AT 1.0 min. | FAILURE AT 2.2 min. |

All failures were caused by chipping occurred at cutting edge

TABLE 10

| HARD COATING LAYER | COMPOSITION OF REACTIVE GAS (volume %) | AMBIENCE PRESSURE (kPa) | AMBIENCE TEMPERATURE (° C.) |
|---|---|---|---|
| TiN | $TiCl_4$: 6%, $N_2$: 35%, $H_2$: BALANCE | 27 | 880 |

TABLE 10-continued

| HARD COATING LAYER | COMPOSITION OF REACTIVE GAS (volume %) | AMBIENCE PRESSURE (kPa) | AMBIENCE TEMPERATURE (° C.) |
|---|---|---|---|
| κ-$Al_2O_3$ | $AlCl_3$: 4%, $CO_2$: 3%, HCl: 2%, $H_2S$: 0.3% $H_2$: BALANCE | 7 | 880 |

TABLE 11

| INSERT | | SUBSTRATE | HARD COATING LAYER INDIVIDUAL 1ST THIN LAYER (μm) | INDIVIDUAL 2nd THIN LAYER (μm) | NUMBER OF ALTERNATED LAYERS | TOTAL THICKNESS (μm) |
|---|---|---|---|---|---|---|
| THIS INVENTION | 1 | A | TiN (0.065) | κ-$Al_2O_3$ (0.035) | 120 | 6.0 |
| | 2 | B | TiN (0.07) | κ-$Al_2O_3$ (0.03) | 100 | 5.0 |
| | 3 | C | TiN (0.03) | κ-$Al_2O_3$ (0.01) | 350 | 7.0 |
| | 4 | D | TiN (0.04) | κ-$Al_2O_3$ (0.01) | 400 | 10.0 |
| | 5 | E | TiN (0.085) | κ-$Al_2O_3$ (0.015) | 140 | 7.0 |
| | 6 | F | TiN (0.09) | κ-$Al_2O_3$ (0.01) | 160 | 8.0 |
| | 7 | G | TiN (0.05) | κ-$Al_2O_3$ (0.03) | 20 | 0.8 |
| | 8 | H | TiN (0.10) | κ-$Al_2O_3$ (0.01) | 40 | 2.2 |
| | 9 | I | TiN (0.085) | κ-$Al_2O_3$ (0.02) | 60 | 3.0 |
| | 10 | J | TiN (0.09) | κ-$Al_2O_3$ (0.03) | 30 | 1.8 |

TABLE 12

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| CONVENTIONAL | 1 | A | TiN (0.2) | 1-TiCN (3.5) | TiCNO (0.3) | κ-$Al_2O_3$ (2) | — |
| | 2 | B | TiCN (0.3) | 1-TiCN (3) | TiCO (0.2) | κ-$Al_2O_3$ (1.5) | — |
| | 3 | C | TiC (1) | 1-TiCN (4) | κ-$Al_2O_3$ (1.8) | — | — |
| | 4 | D | TiN (0.3) | 1-TiCN (8) | TiCNO (0.3) | κ-$Al_2O_3$ (2) | — |
| | 5 | E | TiN (0.3) | 1-TiCN (4) | TiC (2) | TiCNO (0.3) | κ-$Al_2O_3$ (1) |
| | 6 | F | TiN (0.3) | TiCN (7) | κ-$Al_2O_3$ (0.8) | — | — |
| | 7 | G | TiCN (0.5) | κ-$Al_2O_3$ (0.3) | — | — | — |
| | 8 | H | TiN (0.3) | 1-TiCN (2) | κ-$Al_2O_3$ (0.2) | — | — |
| | 9 | I | TiC (0.5) | 1-TiCN (2) | TiCNO (0.2) | κ-$Al_2O_3$ (0.6) | — |
| | 10 | J | TiCN (1.2) | TiCNO (0.2) | κ-$Al_2O_3$ (0.5) | — | — |

TABLE 13

| INSERT | | FLANK WEAR (mm) CONTINUOUS TURNING WITH THICK DEPTH-OF-CUT | FLANK WEAR (mm) CONTINUOUS TURNING WITH HIGH FEED RATE | INSERT | | FLANK WEAR (mm) CONTINUOUS TURNING WITH THICK DEPTH-OF-CUT | FLANK WEAR (mm) CONTINUOUS TURNING WITH HIGH FEED RATE |
|---|---|---|---|---|---|---|---|
| THIS INVENTION | 1 | 0.31 | 0.34 | CONVENTIONAL | 1 | FAILURE AT 4.2 min. | FAILURE AT 1.5 min. |
| | 2 | 0.30 | 0.36 | | 2 | FAILURE AT 3.8 min. | FAILURE AT 1.0 min. |
| | 3 | 0.26 | 0.29 | | 3 | FAILURE AT 2.1 min. | FAILURE AT 2.1 min. |
| | 4 | 0.32 | 0.25 | | 4 | FAILURE AT 1.4 min. | FAILURE AT 0.8 min. |
| | 5 | 0.24 | 0.28 | | 5 | FAILURE AT 2.8 min. | FAILURE AT 0.9 min. |
| | 6 | 0.25 | 0.30 | | 6 | FAILURE AT 3.3 min. | FAILURE AT 1.2 min. |
| | 7 | 0.35 | 0.34 | | 7 | FAILURE AT 3.0 min. | FAILURE AT 1.6 min. |
| | 8 | 0.30 | 0.31 | | 8 | FAILURE AT 3.6 min. | FAILURE AT 1.7 min. |
| | 9 | 0.29 | 0.30 | | 9 | FAILURE AT 2.1 min. | FAILURE AT 1.9 min. |
| | 10 | 0.32 | 0.32 | | 10 | FAILURE AT 2.9 min. | FAILURE AT 2.3 min. |

All failures were caused by chipping occurred at cutting edge

TABLE 14

| INSERT | | SUBSTRATE | HARD COATING LAYER INDIVIDUAL 1ST THIN LAYER (μm) | INDIVIDUAL 2nd THIN LAYER (μm) | NUMBER OF ALTERNATED LAYERS | TOTAL THICKNESS (μm) |
|---|---|---|---|---|---|---|
| THIS INVENTION | 1 | A | TiN (0.01) | κ-$Al_2O_3$ (0.09) | 160 | 8.0 |
| | 2 | B | TiN (0.02) | κ-$Al_2O_3$ (0.08) | 100 | 5.0 |
| | 3 | C | TiN (0.03) | κ-$Al_2O_3$ (0.09) | 160 | 9.6 |
| | 4 | D | TiN (0.03) | κ-$Al_2O_3$ (0.07) | 200 | 10.0 |
| | 5 | E | TiN (0.01) | κ-$Al_2O_3$ (0.03) | 400 | 8.0 |
| | 6 | F | TiN (0.01) | κ-$Al_2O_3$ (0.03) | 200 | 4.0 |
| | 7 | G | TiN (0.01) | κ-$Al_2O_3$ (0.09) | 20 | 10.0 |
| | 8 | H | TiN (0.01) | κ-$Al_2O_3$ (0.03) | 40 | 0.8 |
| | 9 | I | TiN (0.01) | κ-$Al_2O_3$ (0.04) | 120 | 3.0 |
| | 10 | J | TiN (0.02) | κ-$Al_2O_3$ (0.06) | 100 | 4.0 |

TABLE 15

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 5th LAYER |
|---|---|---|---|---|---|---|
| CONVENTIONAL | 1 | A | TiN (0.8) | TiCNO (0.2) | κ-$Al_2O_3$ (7) | — |
| | 2 | B | TiCN (1) | TiCO (0.2) | κ-$Al_2O_3$ (4) | — |
| | 3 | C | TiC (0.5) | 1-TiCN (2) | κ-$Al_2O_3$ (7) | — |
| | 4 | D | TiN (0.3) | 1-TiCN (2.5) | TiCNO (0.3) | κ-$Al_2O_3$ (7) |

TABLE 15-continued

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 5th LAYER |
|---|---|---|---|---|---|---|
| | 5 | E | TiN (0.3) | TiCN (1.5) | TiCNO (0.3) | κ-$Al_2O_3$ (6) |
| | 6 | F | TiN (0.5) | TiCN (0.5) | κ-$Al_2O_3$ (3) | — |
| | 7 | G | TiCN (0.2) | κ-$Al_2O_3$ (0.9) | — | — |
| | 8 | H | TiN (0.3) | κ-$Al_2O_3$ (0.5) | — | — |
| | 9 | I | TiC (0.5) | TiCNO (0.2) | κ-$Al_2O_3$ (2.5) | — |
| | 10 | J | TiCN (1.2) | TiCO (0.2) | κ-$Al_2O_3$ (3) | — |

TABLE 16

| INSERT | | FLANK WEAR (mm) CONTINUOUS TURNING WITH THICK DEPTH-OF-CUT | CONTINUOUS TURNING WITH HIGH FEED RATE | INSERT | | FLANK WEAR (mm) CONTINUOUS TURNING WITH THICK DEPTH-OF-CUT | CONTINUOUS TURNING WITH HIGH FEED RATE |
|---|---|---|---|---|---|---|---|
| THIS INVENTION | 1 | 0.34 | 0.28 | CONVENTIONAL | 1 | FAILURE AT 2.6 min. | FAILURE AT 0.7 min. |
| | 2 | 0.31 | 0.27 | | 2 | FAILURE AT 4.0 min. | FAILURE AT 1.6 min. |
| | 3 | 0.26 | 0.28 | | 3 | FAILURE AT 2.9 min. | FAILURE AT 1.1 min. |
| | 4 | 0.34 | 0.31 | | 4 | FAILURE AT 3.2 min. | FAILURE AT 1.2 min. |
| | 5 | 0.35 | 0.25 | | 5 | FAILURE AT 3.4 min. | FAILURE AT 1.0 min. |
| | 6 | 0.28 | 0.24 | | 6 | FAILURE AT 2.1 min. | FAILURE AT 1.5 min. |
| | 7 | 0.30 | 0.27 | | 7 | FAILURE AT 3.6 min. | FAILURE AT 0.4 min. |
| | 8 | 0.30 | 0.29 | | 8 | FAILURE AT 1.7 min. | FAILURE AT 1.4 min. |
| | 9 | 0.32 | 0.29 | | 9 | FAILURE AT 2.8 min. | FAILURE AT 2.0 min. |
| | 10 | 0.29 | 0.33 | | 10 | FAILURE AT 2.8 min. | FAILURE AT 0.8 min. |

All failures were caused by chipping occurred at cutting edge

TABLE 17

| INSERT | | SUBSTRATE | HARD COATING LAYER INDIVIDUAL 1ST THIN LAYER (μm) | INDIVIDUAL 2nd THIN LAYER (μm) | NUMBER OF ALTERNATED LAYERS | TOTAL THICKNESS (μm) |
|---|---|---|---|---|---|---|
| THIS INVENTION | 1 | A | TiN (0.02) | κ-$Al_2O_3$ (0.04) | 200 | 6.0 |
| | 2 | B | TiN (0.035) | κ-$Al_2O_3$ (0.065) | 160 | 8.0 |
| | 3 | C | TiN (0.04) | κ-$Al_2O_3$ (0.06) | 60 | 3.0 |
| | 4 | D | TiN (0.045) | κ-$Al_2O_3$ (0.055) | 90 | 4.5 |
| | 5 | E | TiN (0.04) | κ-$Al_2O_3$ (0.04) | 240 | 9.6 |
| | 6 | F | TiN (0.055) | κ-$Al_2O_3$ (0.045) | 150 | 7.5 |
| | 7 | G | TiN (0.03) | κ-$Al_2O_3$ (0.02) | 400 | 10.0 |
| | 8 | H | TiN (0.01) | κ-$Al_2O_3$ (0.01) | 80 | 0.8 |

TABLE 17-continued

| INSERT | | SUBSTRATE | HARD COATING LAYER INDIVIDUAL 1ST THIN LAYER (μm) | INDIVIDUAL 2nd THIN LAYER (μm) | NUMBER OF ALTERNATED LAYERS | TOTAL THICKNESS (μm) |
|---|---|---|---|---|---|---|
| | 9 | I | TiN (0.05) | κ-$Al_2O_3$ (0.1) | 40 | 3.0 |
| | 10 | J | TiN (0.1) | κ-$Al_2O_3$ (0.1) | 80 | 8.0 |

TABLE 18

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| CONVENTIONAL | 1 | A | TiN (0.2) | 1-TiCN (2) | TiCNO (0.2) | κ-$Al_2O_3$ (4) | |
| | 2 | B | TiCN (0.5) | 1-TiCN (2.5) | TiCO (0.3) | κ-$Al_2O_3$ (5) | — |
| | 3 | C | TiC (1.2) | κ-$Al_2O_3$ (1.8) | — | — | — |
| | 4 | D | TiN (0.3) | 1-TiCN (1.5) | TiCNO (0.3) | κ-$Al_2O_3$ (2.5) | — |
| | 5 | E | TiN (0.3) | 1-TiCN (3) | TiC (1) | TiCNO (0.3) | κ-$Al_2O_3$ (5) |
| | 6 | F | TiN (1) | TiCN (3) | κ-$Al_2O_3$ (3.5) | — | — |
| | 7 | G | TiN (0.5) | TiC (5) | TiCN (0.5) | TiCO (0.1) | κ-$Al_2O_3$ (4) |
| | 8 | H | TiN (0.2) | TiC (0.2) | κ-$Al_2O_3$ (0.4) | — | — |
| | 9 | I | TiC (1) | TiCNO (0.2) | κ-$Al_2O_3$ (2) | — | — |
| | 10 | J | TiCN (1) | TiC (3.8) | TiCNO (0.3) | κ-$Al_2O_3$ (3) | — |

TABLE 19

| INSERT | | FLANK WEAR (mm) INTERRUPTED TURNING OF ALLOYED STEEL | INTERRUPTED TURNING OF CAST IRON | INSERT | | FLANK WEAR (mm) INTERRUPTED TURNING OF ALLOYED STEEL | INTERRUPTED TURNING OF CAST IRON |
|---|---|---|---|---|---|---|---|
| THIS INVENTION | 1 | 0.26 | 0.25 | CONVENTIONAL | 1 | FAILURE AT 2.2 min. | FAILURE AT 1.7 min. |
| | 2 | 0.31 | 0.32 | | 2 | FAILURE AT 1.8 min. | FAILURE AT 2.4 min. |
| | 3 | 0.30 | 0.34 | | 3 | FAILURE AT 1.1 min. | FAILURE AT 2.3 min. |
| | 4 | 0.28 | 0.33 | | 4 | FAILURE AT 1.6 min. | FAILURE AT 1.6 min. |
| | 5 | 0.33 | 0.29 | | 5 | FAILURE AT 2.0 min. | FAILURE AT 2.4 min. |
| | 6 | 0.25 | 0.29 | | 6 | FAILURE AT 0.9 min. | FAILURE AT 2.0 min. |
| | 7 | 0.32 | 0.28 | | 7 | FAILURE AT 1.5 min. | FAILURE AT 1.3 min. |
| | 8 | 0.39 | 0.40 | | 8 | FAILURE AT 0.4 min. | FAILURE AT 0.9 min. |
| | 9 | 0.31 | 0.32 | | 9 | FAILURE AT 2.2 min. | FAILURE AT 1.5 min. |
| | 10 | 0.26 | 0.27 | | 10 | FAILURE AT 1.6 min. | FAILURE AT 2.3 min. |

All failures were caused by chipping occurred at cutting edge

TABLE 20

| HARD COATING LAYER | COMPOSITION OF REACTIVE GAS (volume %) | AMBIENCE PRESSURE (kPa) | AMBIENCE TEMPERATURE (° C.) |
|---|---|---|---|
| TiN | $TiCl_4$: 4.2%, $N_2$: 35%, $H_2$: BALANCE | 25 | 960 |
| TiCN | $TiCl_4$: 4.2%, $N_2$: 20%, $CH_4$: 4%, $H_2$: BALANCE | 7 | 960 |

TABLE 20-continued

| HARD COATING LAYER | COMPOSITION OF REACTIVE GAS (volume %) | AMBIENCE PRESSURE (kPa) | AMBIENCE TEMPERATURE (° C.) |
|---|---|---|---|
| $HfO_2$ | $HfCl_4$: 3.5%, $CO_2$: 6%, HCl: 1.5%, $H_2$: BALANCE | 7 | 960 |

TABLE 21

| INSERT | | SUBSTRATE | HARD COATING LAYER: TARGET THICKNESS OF INDIVIDUAL 1ST THIN LAYER (μm) | TARGET THICKNESS OF INDIVIDUAL 2ND THIN LAYER (μm) | NUMBER OF ALTERNATED LAYERS: TIN THIN LAYER | TICN THIN LAYER | $HFO_2$ THIN LAYER | TOTAL THICKNESS (μm) |
|---|---|---|---|---|---|---|---|---|
| THIS INVENTION | 1 | A | 0.05 | 0.05 | 44 | — | 44 | 4.4 |
| | 2 | B | 0.1 | 0.1 | — | 29 | 29 | 5.8 |
| | 3 | C | 0.02 | 0.05 | — | 43 | 43 | 3.0 |
| | 4 | D | 0.03 | 0.1 | — | 24 | 24 | 3.1 |
| | 5 | E | 0.01 | 0.05 | 110 | — | 110 | 6.6 |
| | 6 | F | 0.08 | 0.02 | 75 | — | 75 | 7.5 |
| | 7 | G | 0.05 | 0.05 | — | 100 | 100 | 10.0 |
| | 8 | H | 0.01 | 0.01 | 40 | — | 40 | 0.8 |
| | 9 | I | 0.03 | 0.07 | 10 (lower part) | 22 (upper part) | 32 | 3.2 |
| | 10 | J | 0.1 | 0.05 | 20 (upper part) | 34 (lower part) | 54 | 8.1 |

TABLE 22

| INSERT | | SUBSTRATE | HARD COATING LAYER (FIGURE IN PARENTHESIS MEANS DESIGNED THICKNESS; μm): 1st LAYER | 2nd LAYER | 3rd LAYER | 4th LAYER | 5th LAYER |
|---|---|---|---|---|---|---|---|
| CONVENTIONAL | 1 | A | TiN (0.2) | TiCNO (0.2) | κ-$Al_2O_3$ (4) | — | — |
| | 2 | B | TiCN (0.5) | TiCO (0.3) | α-$Al_2O_3$ (5) | — | — |
| | 3 | C | TiC (1.2) | κ-$Al_2O_3$ (1.8) | — | — | — |
| | 4 | D | TiN (0.3) | TiCNO (0.3) | α-$Al_2O_3$ (2.5) | — | — |
| | 5 | E | TiN (0.3) | TiC (1) | TiCNO (0.3) | κ-$Al_2O_3$ (5) | — |
| | 6 | F | TiN (1) | TiCN (3) | α-$Al_2O_3$ (3.5) | — | — |
| | 7 | G | TiN (0.5) | TiC (5) | TiCN (0.4) | TiCO (0.1) | κ-$Al_2O_3$ (4) |
| | 8 | H | TiN (0.2) | TiC (0.2) | κ-$Al_2O_3$ (0.4) | — | — |
| | 9 | I | TiC (1) | TiCNO (0.2) | α-$Al_2O_3$ (2) | — | — |
| | 10 | J | TiCN (1) | TiC (3.8) | TiCNO (0.3) | α-$Al_2O_3$ (3) | — |

TABLE 23

| INSERT | | FLANK WEAR (mm) CONTINUOUS TURNING OF ALLOYED STEEL | FLANK WEAR (mm) INTERRUPTED TURNING OF STAINLESS STEEL | INSERT | | FLANK WEAR (mm) CONTINUOUS TURNING OF ALLOYED STEEL | FLANK WEAR (mm) INTERRUPTED TURNING OF STAINLESS STEEL |
|---|---|---|---|---|---|---|---|
| THIS INVENTION | 1 | 0.28 | 0.26 | CONVENTIONAL | 1 | 0.58 | 0.52 |
| | 2 | 0.32 | 0.33 | | 2 | 0.65 | 0.57 |
| | 3 | 0.35 | 0.31 | | 3 | 0.77 | 0.66 |
| | 4 | 0.31 | 0.29 | | 4 | 0.70 | 0.59 |
| | 5 | 0.26 | 0.26 | | 5 | 0.65 | 0.63 |
| | 6 | 0.24 | 0.25 | | 6 | 0.59 | 0.57 |
| | 7 | 0.24 | 0.28 | | 7 | 0.56 | 0.54 |
| | 8 | 0.36 | 0.32 | | 8 | 0.80 | 0.80 |
| | 9 | 0.32 | 0.27 | | 9 | 0.79 | 0.68 |
| | 10 | 0.24 | 0.25 | | 10 | 0.64 | 0.53 |

All failures were caused by chipping occurred at cutting edge

TABLE 24

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER | 6th LAYER | 7th LAYER | 8th LAYER | 9th LAYER | TOTAL THICKNESS |
|---|---|---|---|---|---|---|---|---|---|---|---|---|
| THIS INVENTION | 1 | A | TiN (0.25) | $HfO_2$ (0.25) | TiN (0.25) | $HfO_2$ (0.25) | — | — | — | — | — | 1.0 |
| | 2 | B | TiCN (0.5) | $HfO_2$ (0.75) | TiN (0.75) | $HfO_2$ (0.5) | TiN (0.5) | — | — | — | — | 3.0 |
| | 3 | C | TiCN (0.25) | $HfO_2$ (0.25) | TiCN (0.25) | $HfO_2$ (0.25) | TiCN (0.25) | $HfO_2$ (0.25) | — | — | — | 1.5 |
| | 4 | D | TiN (0.3) | $HfO_2$ (0.45) | TiN (0.45) | $HfO_2$ (0.45) | TiN (0.45) | $HfO_2$ (0.45) | TiN (0.45) | — | — | 3.0 |
| | 5 | E | TiCN (0.75) | $HfO_2$ (0.75) | TiCN (0.75) | $HfO_2$ (0.75) | TiCN (0.75) | $HfO_2$ (0.75) | — | — | — | 4.5 |
| | 6 | F | TiN (0.6) | $HfO_2$ (0.7) | TiN (0.6) | $HfO_2$ (0.7) | TiN (0.6) | $HfO_2$ (0.7) | — | — | — | 4.0 |
| | 7 | G | TiCN (0.75) | $HfO_2$ (0.75) | TiCN (0.75) | $HfO_2$ (0.75) | TiN (0.75) | $HfO_2$ (0.3) | TiN (0.75) | — | — | 4.8 |
| | 8 | H | TiN (0.3) | $HfO_2$ (0.3) | TiN (0.3) | $HfO_2$ (0.4) | TiCN (0.3) | $HfO_2$ (0.5) | TiCN (0.3) | $HfO_2$ (0.6) | — | 3.0 |
| | 9 | I | TiCN (0.3) | $HFO_2$ (0.3) | TiN (0.3) | $HfO_2$ (0.3) | TiCN (0.3) | $HfO_2$ (0.25) | — | — | — | 2.5 |
| | 10 | J | TiN (0.7) | $HfO_2$ (0.75) | TiCN (0.7) | κ-$Al_2O_3$ (0.7) | TiN (0.7) | α-$Al_2O_3$ (0.7) | — | — | — | 6.0 |

TABLE 25

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| CONVENTIONAL | 1 | A | TiN (0.2) | TiCN (0.5) | TiCNO (0.1) | κ-$Al_2O_3$ (0.2) | — |
| | 2 | B | TiC (0.5) | TiCN (1.5) | TiCO (0.2) | α-$Al_2O_3$ (0.8) | — |
| | 3 | C | TiCN (0.5) | α$Al_2O_3$ (1) | — | — | — |
| | 4 | D | TiC (0.3) | TiCN (1.5) | TiC (0.5) | TiCN (0.2) | κ-$Al_2O_3$ (0.5) |
| | 5 | E | TiCN (0.5) | TiC (2) | TiN (0.3) | κ-$Al_2O_3$ (1.7) | — |
| | 6 | F | TiN (1.5) | TiCNO (0.2) | α-$Al_2O_3$ (2.2) | — | — |
| | 7 | G | TiC (1) | TiCO (1) | TiCN (2) | TiCNO (0.3) | α-$Al_2O_3$ (0.5) |
| | 8 | H | TiCN (2) | κ-$Al_2O_3$ (1) | — | — | — |

TABLE 25-continued

| INSERT | | SUBSTRATE | HARD COATING LAYER (FIGURE IN PARENTHESIS MEANS DESIGNED THICKNESS; μm) 1st LAYER | 2nd LAYER | 3rd LAYER | 4th LAYER | 5th LAYER |
|---|---|---|---|---|---|---|---|
| | 9 | I | TiN (0.3) | TiCN (0.7) | κ-$Al_2O_3$ (1.5) | — | — |
| | 10 | J | TiN (1) | TiCN (2) | TiN (0.7) | TiCNO (0.3) | κ-$Al_2O_3$ (2) |

TABLE 26

| INSERT | | FLANK WEAR (mm) CONTINUOUS TURNING OF ALLOYED STEEL | INTERRUPTED TURNING OF STAINLESS STEEL | INSERT | | FLANK WEAR (mm) CONTINUOUS TURNING OF ALLOYED STEEL | INTERRUPTED TURNING OF STAINLESS STEEL |
|---|---|---|---|---|---|---|---|
| THIS INVEN-TION | 1 | 0.31 | 0.26 | CONVEN-TIONAL | 1 | 0.56 | 0.48 |
| | 2 | 0.31 | 0.30 | | 2 | 0.54 | 0.51 |
| | 3 | 0.29 | 0.32 | | 3 | 0.49 | 0.63 |
| | 4 | 0.28 | 0.27 | | 4 | 0.60 | 0.54 |
| | 5 | 0.24 | 0.25 | | 5 | 0.50 | 0.53 |
| | 6 | 0.28 | 0.27 | | 6 | 0.48 | 0.61 |
| | 7 | 0.25 | 0.26 | | 7 | 0.59 | 0.62 |
| | 8 | 0.29 | 0.29 | | 8 | 0.62 | 0.57 |
| | 9 | 0.32 | 0.30 | | 9 | 0.53 | 0.56 |
| | 10 | 0.26 | 0.24 | | 10 | 0.50 | 0.49 |

All failures were caused by chipping occurred at cutting edge

What is claimed is:

1. A coated cemented carbide cutting tool member, comprising a hard sintered substrate and a hard coating layer deposited on the surface of the substrate, wherein the hard coating layer comprises an alternating multilayer structure having a total thickness in a range of from 0.5 to 20 μm and comprising a first thin layer of titanium compounds and a second thin layer of hard oxide materials whose individual thickness is in a range of from 0.01 to 0.3 μm; and the thickness ratio of the second thin layer to the first thin layer is in a range of from 2 to 4.

2. The coated cemented carbide cutting tool member according to claim 1, wherein the first thin layer is made of at least one layer selected from TiC, TiCN and TiN.

3. The coated cemented carbide cutting tool member according to any one of claims 1 and 2, wherein the second thin layer is made of $Al_2O_3$.

4. The coated cemented carbide cutting tool member according to any one of claims 1 and 2, wherein the second thin layer is made of $HfO_2$.

5. The coated cemented carbide cutting tool member according to any one of claims 1 and 2, wherein the total thickness of the hard coating layer is in a range of from 0.8 to 10 μm.

6. The coated cemented carbide cutting tool member according to claim 5, wherein the total thickness of the hard coating layer is in a range of from 1 to 6 μm.

7. The coated cemented carbide cutting tool member according to claim 1, wherein the thickness ratio of the second thin layer to the first thin layer is in a range of from 2.5 to 3.5.

8. A method of making a cutting tool member, the method comprising coating a hard coating layer on a hard sintered substrate; and producing the coated cemented carbide cutting tool member of claim 1.

* * * * *